United States Patent [19]

Thompson et al.

[11] 3,959,010

[45] May 25, 1976

[54] VORTEX CLEANER AND METHOD OF CLEANING

[75] Inventors: David L. Thompson, Long Beach; Edward E. Headrick, La Canada, both of Calif.

[73] Assignee: Thompson Tank Manufacturing Company, Long Beach, Calif.

[22] Filed: Sept. 30, 1974

[21] Appl. No.: 510,579

[52] U.S. Cl. ..... 134/21; 134/10; 134/104; 134/154; 15/320; 15/353

[51] Int. Cl.[2] ..... B08B 5/04

[58] Field of Search ..... 134/21, 37, 10, 154, 134/104, 302, 320; 15/353, 320, 302

[56] References Cited

UNITED STATES PATENTS

| | | | |
|---|---|---|---|
| 2,458,258 | 1/1949 | Furr | 15/353 X |
| 3,079,285 | 2/1963 | Rockwell | 134/21 X |
| 3,447,188 | 6/1969 | Maasberg | 15/320 |

*Primary Examiner*—Arthur O. Kellogg
*Attorney, Agent, or Firm*—Fulwider, Patton, Rieber, Lee & Utecht

[57] ABSTRACT

There is disclosed a mobile cleaning unit which utilizes air vortexes to scour the surface of streets, pavement and the like and to remove finely subdivided debris therefrom. The vortexes are generated by a vacuum which is applied through a cleaning head bearing apertures of limited cross sectional area to provide a minimal air flow therethrough of at least about 200 cubic feet per minute per square inch of aperture area. The vacuum is at least about three, preferably at least five inches mercury beneath atmospheric pressure resulting in the development of a well defined air vortex at the inlet to each of the apertures of the cleaning head. The cleaning head is supported and moved across the surface to be cleaned at an elevation sufficient to place the base of the vortex on the work surface. In the preferred embodiment, the cleaning head also includes a plurality of water spray nozzles which are directed to impinge a water spray onto the work surface adjacent the vortex, thereby washing the surface and lifting all adsorbed or occluded debris therefrom. The invention also includes vacuum support facilities including an air separator which operates under "wet" conditions wherein the debris is centrifically separated from the air stream in the presence of water droplets which are coalesced by the centrifugal action and assist in washing the debris from the air stream.

20 Claims, 14 Drawing Figures

FIG. 3
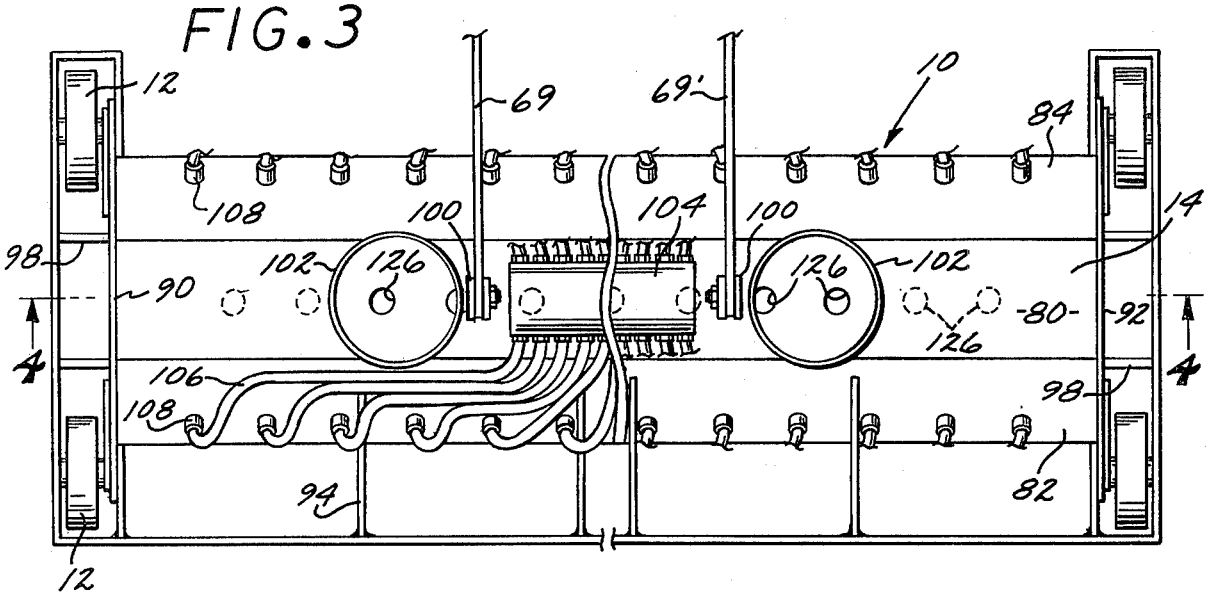
FIG. 4
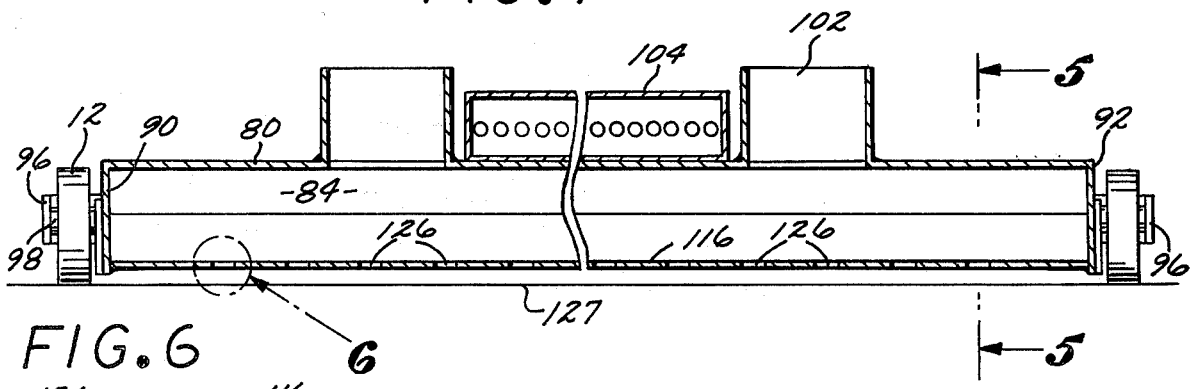
FIG. 6
FIG. 5
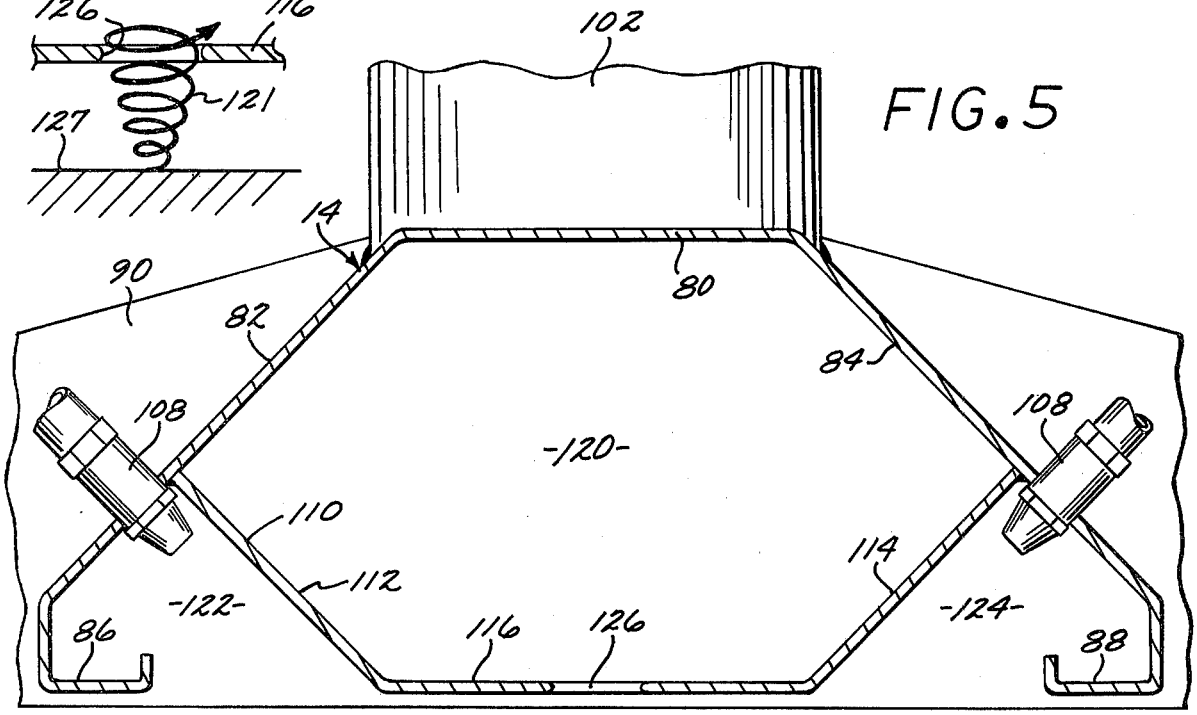

FIG. 7
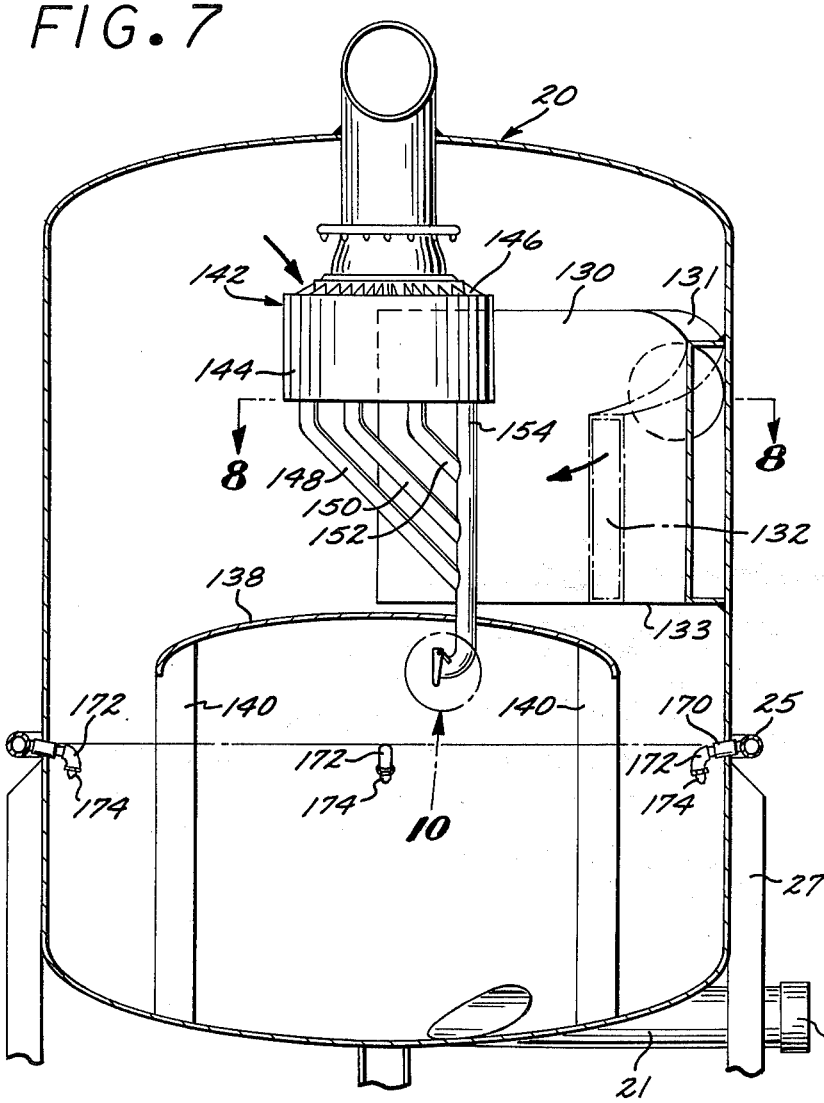
FIG. 9
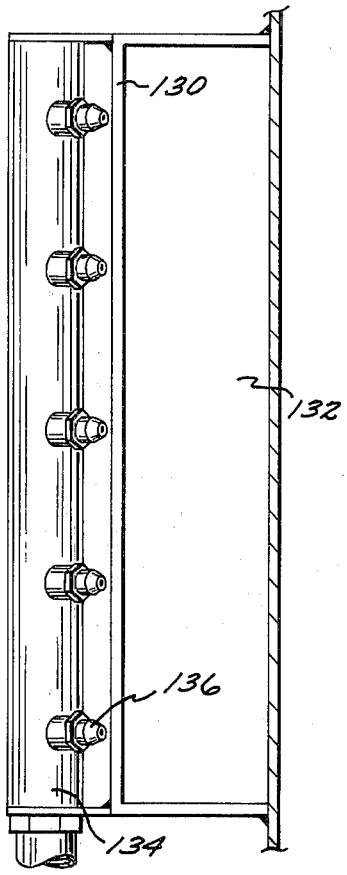
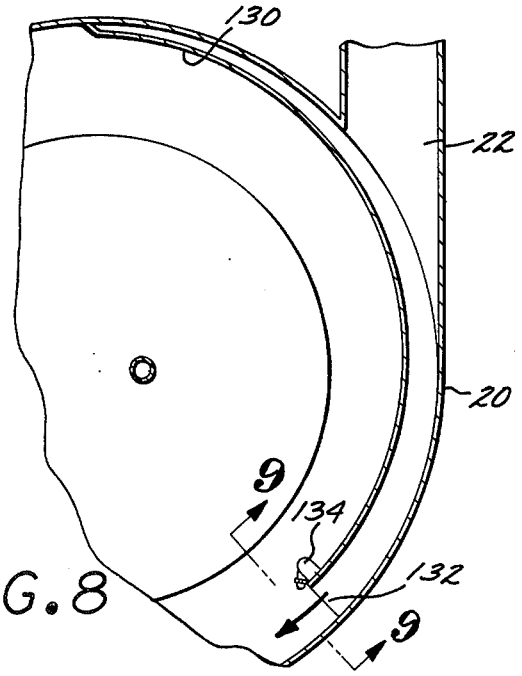
FIG. 8
FIG. 10
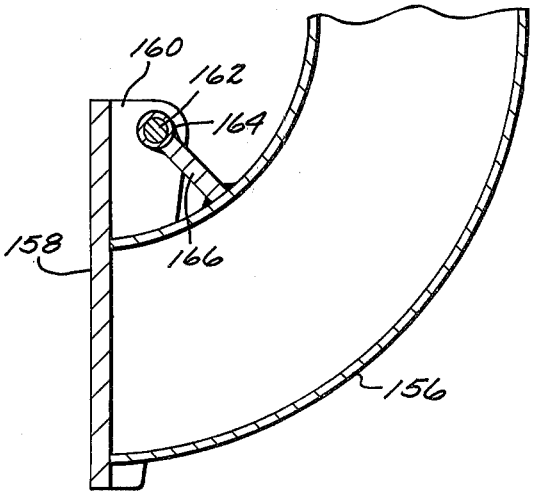

FIG. 11
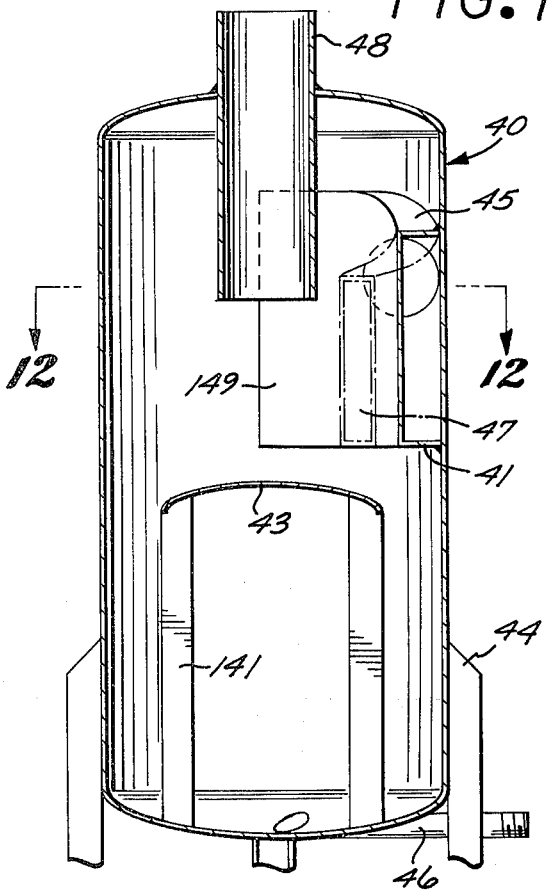
FIG. 12
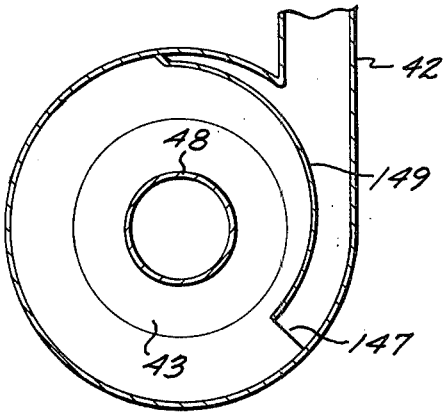
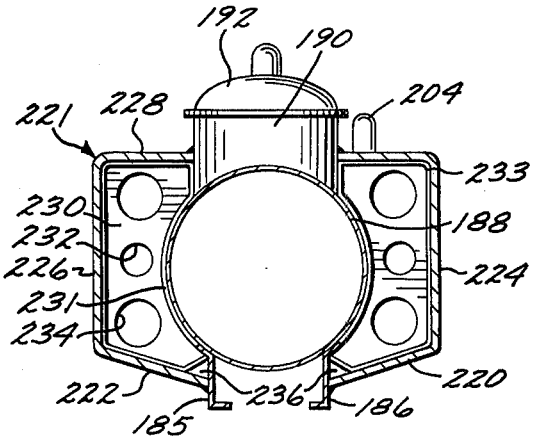
FIG. 13
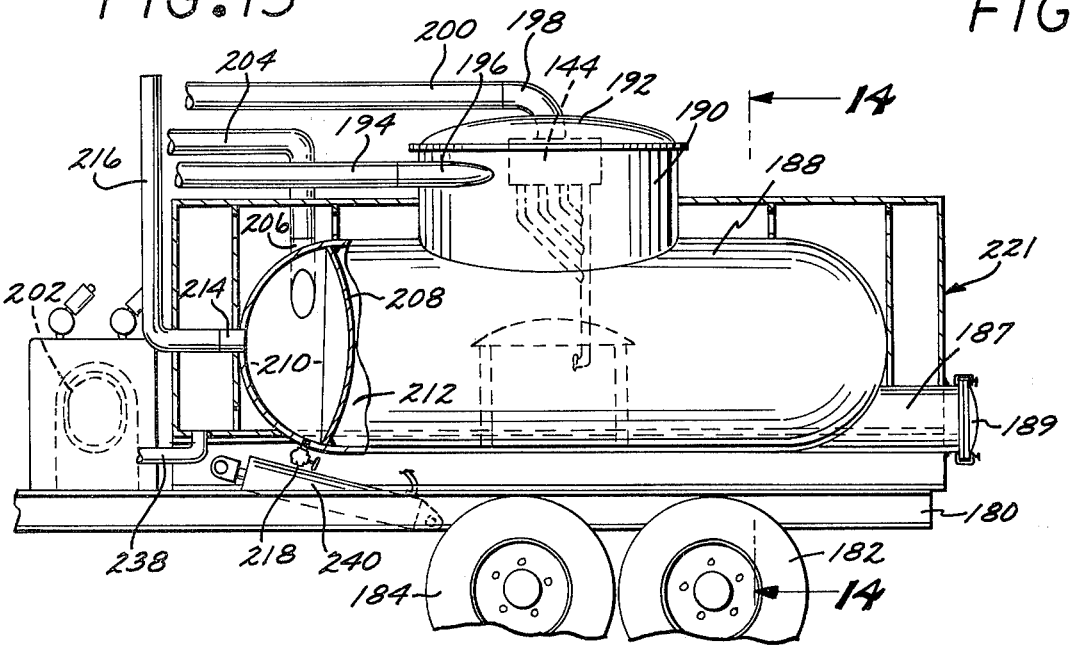
FIG. 14

VORTEX CLEANER AND METHOD OF CLEANING

BACKGROUND OF THE INVENTION

1. Field of Invention

This invention relates to a cleaning device and, in particular, to a device for the cleaning of streets, pavement and the like of finely subdivided dust and debris or for the drying of wetted surfaces like artificial turf and the like. 2. Description of the Prior Art A variety of mechanical devices have been employed for the cleaning of pavements such as streets and industrial work areas and the like. A typical city street cleaner employs a plurality of rotating brush heads which are supported from the bed of a truck and which operate to sweep debris toward the center of the truck where it can be picked up by a vacuum head. This type of device is entirely ineffective for the cleaning of pavements which have finely subdivided debris and dust thereon. Another type of cleaning device employs a vacuum head in the form of a tubular member having large diameter apertures or an elongated slot disposed along its length. This cleaning head is moved across its surface of the pavement and the air which flows into the head entrains the dust or finely subdivided debris into the vacuum system of the cleaning device. Heretofore, this type of cleaning device has not been employed with adequate vacuum support facilities and the apertures or slots of the cleaning head are oversized for such facilities resulting in the inability of this unit to develop well defined air vortexes that would scour or scrub the pavement surface by the high velocity air stream of the vortex. Additionally, such devices have not employed the simultaneous application of water sprays to the surface whereby the surface can be scrubbed or scoured in an efficient manner.

Another common failing of the prior art devices is that most of these devices have employed various filtering means such as filter cloths, bags and the like, for separating of entrained dirt and debris from the air stream. These devices are relatively inefficient when employed with finely subdivided solids and either rapidly clog and require frequent maintenance or permit the escape of the particles to the atmosphere.

BRIEF STATEMENT OF THE INVENTION

This invention provides means and method for the efficient vacuum cleaning of finely subdivided dirt, and debris, or water from a surface. The method comprises the generation of well defined air vortexes at the inlet to a vacuum head by applying a vacuum of at least about three inches mercury beneath atmospheric pressure to said head and exhausting air therefrom at a volumetric flow rate of at least about 200 standard cubic feet per minute per square inch of area of the inlet aperture and then positioning the vacuum head above the pavement at a distance of from about 0.5 to about 5 inches to locate the base of the vortexes on the surface and applying the high velocity air of the vortex to the surface to scour the surface clean of water or finely subdivided dirt and debris. The method can also include applying a water spray onto the surface of the pavement immediately adjacent the bases of the vortexes so that the water will wash the surface and the dirt and water will be entrained into the vortex and removed through the vacuum system of the cleaning unit.

The cleaning apparatus employed in the invention includes a cleaning head in the form of a tubular header having a plurality of air intake apertures positioned along its undersurface. In the preferred embodiment, a plurality of water spray nozzles are also positioned along the header and oriented to direct their discharges beneath the air intake apertures. The vacuum head is connected to a source of vacuum that has a capacity to provide an air flow of at least about 200 cubic feet per minute per square inch of the total area of the air intake apertures.

In the preferred embodiment, the vacuum source includes an entrainment air separator which is a circular vessel with inlet means to direct the air stream in a tangental direction about its periphery. The air separator can also include a conventional centrifical separator mounted in the vessel to receive air therefrom and to clarify the air stream of entrained solid and liquid particles. The air separator is operated under wet conditions and, accordingly, sufficient water droplets are supplied thereto either by entrainment of wash water from the spray nozzles of the cleaning head or by the injection of a water spray into the air stream entering the air separator vessel to produce a coalescing action of water droplets therein, thereby greatly improving its efficiency for the removal of finely subdivided solid particles.

BRIEF DESCRIPTION OF THE DRAWINGS

The invention is described with reference to the figures of which:

FIGS. 3–5 are plan and front and side sectional, views, respectively, of the vacuum head employed in the invention;

FIG. 6 illustrates an air vortex formed by the vacuum head;

FIG. 7 is a sectional elevation view of the air separator employed in the invention;

FIGS. 8–10 illustrate internal details of the air separator;

FIGS. 11 and 12 are side and plan sectional views, respectively, of the muffler used in the invention;

FIGS. 13 and 14 are views of another prototype of the invention.

DESCRIPTION OF PREFERRED EMBODIMENTS

Figure 1:
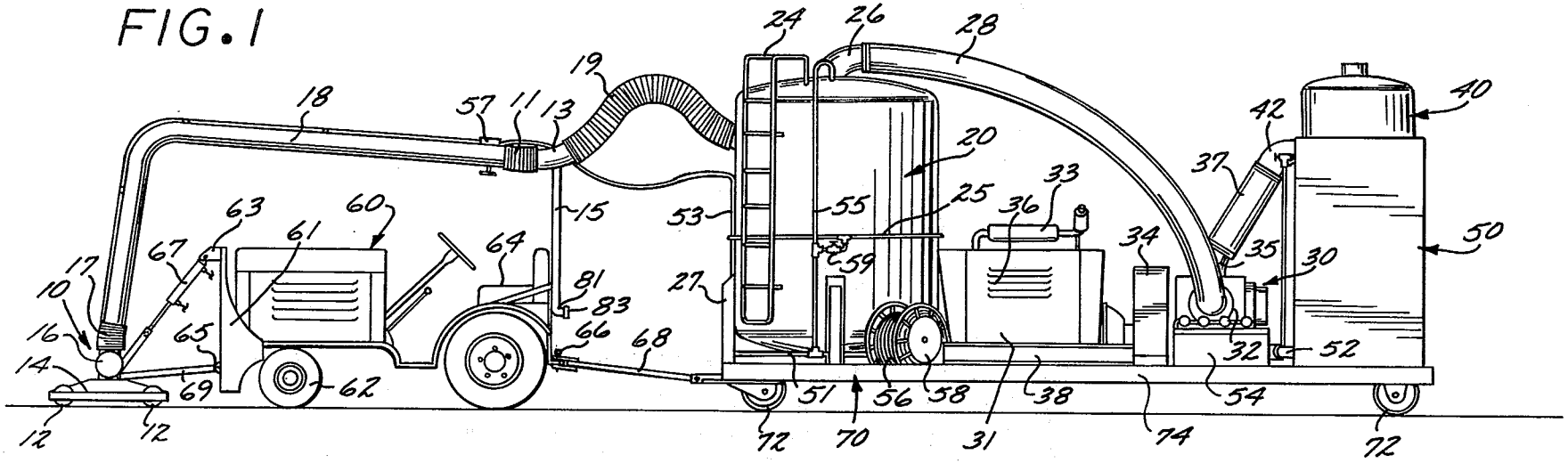
FIGS. 1 and 2 are side elevation drawings of an engineering prototype of the invention.
Figure 2:
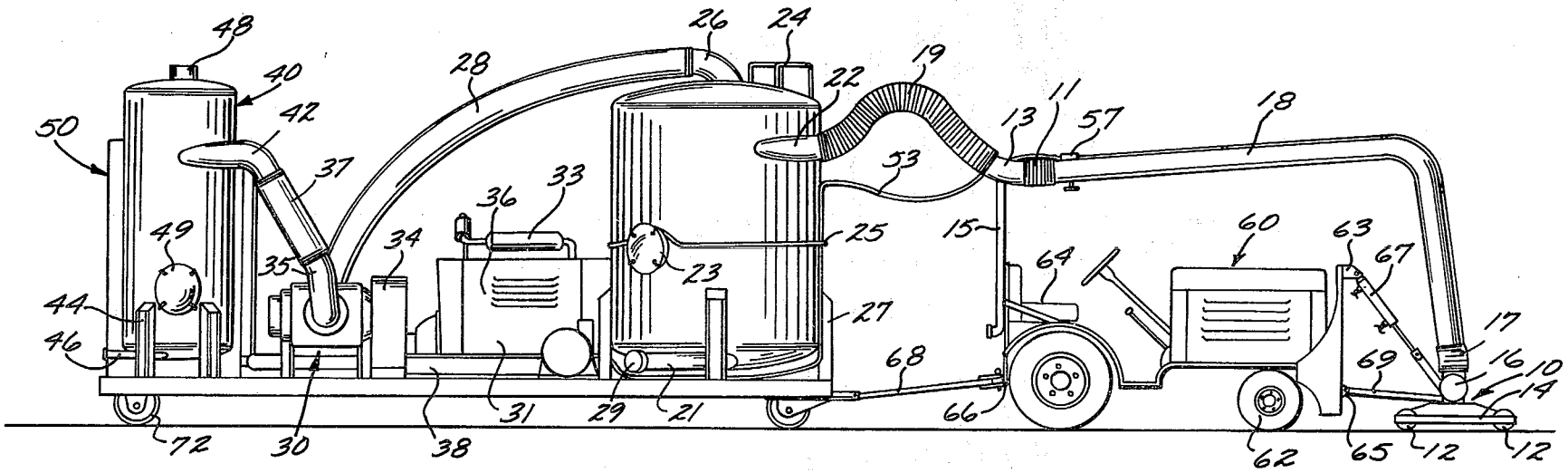

Referring now to FIGS. 1 and 2, an engineering prototype of the invention is illustrated. The cleaning unit comprises a vacuum head 10, an air separator 20, a vacuum supply means 30, a muffler and exhaust gas conditioner 40, and a water tank 50. The cleaning unit is mounted upon a mobile base and, to this end, a suitable propulsion unit 60 is included. As illustrated, the propulsion unit comprises a small tractor with steerable front wheels 62 and an operator's station in the form of seat 64. The tow bar 66 of propulsion unit 60 is connected by tongue 68 to trailer 70 which bears front and rear support wheels 72 attached to the underside of a substantially flat platform 74 which forms a base on which are mounted the support facilities of the air separator 20, vacuum source 30, exhaust gas conditioner 40, and water tank 50.

The vacuum head 10, described in greater detail hereafter, bears wheels 12 fore and aft of the head housing 14. The housing 14 is carried by the fore end of the propulsion means 60 which bears a suitable plate 61 which carries support brackets 63 and 65. Vacuum head 10 is carried on plate 61 by brackets 65 and 63, being pivotally mounted on bracket 65 by link member 69. A hydraulic cylinder 67 projects from bracket 63 and connects to a lift arm also pivotally mounted on vacuum head 10 whereby the vacuum head can be raised and lowered in a pivotal movement about bracket 65. Power for the actuation of hydraulic cylinder 67 can be supplied by hydraulic means, not shown, carried on propulsion unit 60.

The vacuum head 10 bears a tubular header 16 which is connected by a short length of flexible conduit 17 to vacuum line 18 which is a generally L-shaped tubular conduit of rigid construction. The vacuum line 18 is carried on the propulsion means 60 by upright standard 15 that is secured to the rear portion of the propulsion means 60 and that bears at its upper end, a coupling 13 for attachment of flexible conduit 19 and a shorter length 11 of flexible conduit thereby providing an articulated support for the rear ends of the L-shaped rigid conduit. Flexible conduit 19 leads to inlet nozzle 22 of vessel 20. Standard 15 can be a tubular member, open to the vacuum line 18 and can bear, at its lower end a nozzle 81 covered by removable cap 83. This provides means to connect a flexible hose into the vacuum system for cleaning of areas not accessible to the cleaning head 10.

Air separation vessel 20 is carried on platform 70 by a plurality of support legs 27 welded to the exterior of this separation vessel. A drain nozzle 21 is provided in the bottom head of vessel 20 and this nozzle is closed by a hinged plate 29. A ladder 24 is provided for access to the upper end of vessel 20. Centrally positioned in the top dome of vessel 20 is nozzle 26 that serves as the air outlet from the vessle. Nozzle 26 is connected by conduit 28 to the inlet of the vacuum source 30.

Vacuum source 30 can be a centrifugal blower 32 which is connected through a suitable drive means 34 to a power source 36 such as a conventional six or eight cylinder internal combustion engine. This engine is carried on a support frame 38 secured to platform 70 and is enclosed by a housing 31. The exhaust from the engine passes through suitable muffler means 33.

The water facilities employed in the invention include the water supply vessel 50 having an outlet nozzle 52 connected to the inlet of pump means 54 that is driven through suitable gearing (not shown) by engine 36. The water pump 54 discharges into water conduits 51 extending along platform 70 which connect to the water hose 56 carried on hose reel 58 and to water supply line 53 which leads to the water manifold and associated spray nozzles carried on vacuum head 10, described in greated detail hereafter. The water supply facilities also include conduit 55 which extends from the water supply header 51 to the upper end of vessel 20 where the line enters this vessel and is connected to suitable spray means described in greater detail hereafter. Conduit 55 is also connected through valve means 59 to circular header 57 which surrounds the lower end of vessel 20 and which is also connected to suitable spray means internal of vessel 20 in a manner described hereinafter.

Referring now to FIGS. 3–5, the vacuum head 10 employed in the invention will be described. The vacuum head 10 is formed by housing 14 defined by a flat upper plate 80 and dependant and inclined fore plate 82 and aft plate 84. These plates extend downwardly to the base of the vacuum head and are formed with a reverse bend to provide a narrow flange portion 86 and 88 at the front and rear of the vacuum head, respectively.

Referring now to FIG. 3, the housing 14 bears, at its outboard ends, end plates 90 and 92 which are in the form of truncated triangular plates that support, at their opposite ends, bearings for wheels 12. Fore plate 82 of housing 14 also bears a plurality of forwardly extending brakes 94 which support, at their outboard ends, a protective rail 96 that surrounds the sides and front of vacuum head 10. The sides of rail 96 are supported by brackets 98 that extend outwardly from end plates 90 and 92. The support arms 69 and 69′ that pivotally attach vacuum head 10 to the support plate 61 on propulsion means 60 are shown in their pinned connection to brackets 100 carried on the top plate 80 of housing 14.

The vacuum header 16, see FIGS. 1 and 2, surmounts and interconnects vacuum nozzles 102 which communicate with the interior of housing 14. Centrally positioned on top plate 80 of housing 14 is a water supply header 104 which is a short length of a tubular member having a plurality of nozzles arranged in longitudinal rows along its rear and forward sides. These nozzles are connected by branch conduits 106, which can be flexible hoses, copper tubing and the like, to water nozzles 108 which are carried in longitudinal rows, one each on each of fore plate 82 and aft plate 84 of housing 14.

Referring now to FIG. 5, the housing 14 can be seen to have a trough-shaped bottom plate 110 defined by inclined fore and aft bottom walls 112 and 114, respectively, and a substantially flat central bottom wall 116. Plate 110 thereby divides the housing 14 into a central vacuum compartment 120 and fore and aft compartments 122 and 124. Water nozzles 108 which are carried in longitudinal rows on plates 82 and 84 extend into and communicate with compartments 122 and 124 with their discharge ends directed downwardly through the longitudinal openings in the undersurface of these compartments, thereby permitting water discharged from these nozzles to impinge against the pavement surface 127, see FIG. 4.

The vacuum compartment 120 (FIG. 5) in housing 14 bears a plurality of ports. Preferably these are disposed in a longitudinal row along bottom plate 116 with the spacing shown in FIG. 3 where they can be seen to comprise a longitudinal row of apertures in regular spacings. The spacing, diameter and number of these ports or apertures 126 and their relationship to the capacity of the vacuum supply means 30 are critical to the proper functioning of the invention in the manner described hereinafter. FIG. 6 illustrates the vortex 121 which is developed in the air stream entering the vacuum compartment 120 during operation of the cleaning unit.

Referring now to FIGS. 7–10, the air separation facilities will be discussed. The air separator comprises a vessel 20 having an inlet nozzle 22 which is arranged for tangental introduction of air and entrained solids and liquids received from the vacuum head 10. The arrangement of this nozzle on vessel 20 is illustrated best in FIG. 8 which shows the nozzle discharging against an arcuate baffle member 130 that is positioned on the inside surface of vessel 20 adjacent the inlet nozzle 22 and that bears upper and lower walls 131 and 133 to define an inlet header which diverges inwardly. Desirably, the flow area of the outlet 132 from baffle 130 is approximately the same or, most preferably, slightly lesser in cross sectional area than the cross sectional area of nozzle 22 to maintain a suitably high velocity of air therethrough. The desired discharge flow area can be achieved by inclining upper wall 131 downwardly, as shown in FIG. 7.

Vessel 20 is designed for wet separation, i.e., separation of solid matter from the air stream by the action of coalescing droplets of water. As previously mentioned, the vacuum head 10 has spray means 108 for the application of water to the pavement surface from where it is entrained into the air stream entering the vacuum head and carried into the separator. In some operation it can be desirable to operate the vacuum head dry and water should then be injected into vessel 20 to provide the desired coalescing of water droplets in the air circulating in this vessel. For this reason, a water supply line 55, shown in FIGS. 1 and 2, is connected to a spray header 134 that is positioned on the inboard end of baffle 130. This header is illustrated in FIG. 9 as comprising a tubular member dependant from the inside edge of baffle 130 and carrying a plurality of water spray nozzles 136 which are positioned to direct their discharge sprays into the path of the air stream entering vessel 20.

A dished plate 138 is centrally positioned within vessel 20 at an intermediate height on support legs 140 which extend to the bottom of vessel 20. This plate serves to prevent the circulating air within vessel 20 from developing a vortex in the liquid that is collected within vessel 20. As previously mentioned, vessel 20 has an outlet nozzle 21 which extends from the bottom dome of this vessel. The outlet nozzle 21 is closed with a suitable closure member such as cap or end flange 29 which is, preferably pivotally carried on nozzle 21.

Centrally positioned in the upper portion of vessel 20 is a suitable air separator 42. This separator can be of conventional design and construction such as a Zurn centrifical separator. A suitable separator is made by the Anderson Company of Cleveland, Ohio, under the designation of internal type Bl-Hi-eF purifier. This purifier has a generally cylindrical housing 144 with a plurality of inclined radially disposed baffles 146 for introducing a swirling motion to gases entering the separator. The second set of internal baffles, not shown, further increase the spinning of the vapors in the separator. Entrained solids and liquids in the air stream are coalesced therefrom and collected in compartments of the separator to be drained therefrom by ejector legs in the form of conduits 148–154. In the adaption of the aforedescribed unit to the wet separator of this invention, the ejector legs 148–152 extend into a common ejector leg 154 and the latter is provided with suitable check valve means to prevent back flow of air and entrained material from vessel 20 into separator 142.

The check valve means employed in the invention comprises a 90° elbow 156 positioned at the lower end of stand pipe leg 154. A flapper valve is mounted on the discharge end of this elbow in the form of a flat baffle plate 158 which has wings 160 projecting from its outer sides to form supports for pin 162 that extends through apertures in this baffle and through tube 164 carried by plate 166.

Vessel 20 is surrounded at its lower extremity by circular header 25 from which depend a plurality of nipples that connect to nozzles 170 which extend through the side wall of the vessel 20. These nozzles can be threaded and bear, from their inboard ends, elbows 172 and associated water jet nozzles 174 which are directed downwardly and outwardly to spray against the side wall of the vessel, facilitating washing of accumulated debris from the side walls during cleaning of the vessel. A total of eight of these nozzles can be provided at 45 degree centers about the periphery of vessel 20 to insure adequate washing of the interior side wall and bottom of this vessel.

The exhaust gas treatment and muffler facilities contained with vessel 40 are shown in FIGS. 11 and 12. As there illustrated, vessel 40 is similar in construction to separator vessel 20 and has its inlet nozzle 42 mounted for tangental introduction of the air stream which is directed against spiral baffle plate 149 which is mounted on the internal side wall of the vessel. This baffle plate has top and bottom plates 45 and 41 and a discharge port 47 which, preferably, is approximately the same cross sectional area and, most preferably, a slightly lesser cross sectional area, than the cross sectional area of inlet nozzle 42. The bottom of vessel 40 is provided with a drain nozzle 46 which can be threaded, as shown, for the attachment of conventional pipe fixtures such as a valve and the like. The upper end of vessel 40 bears centrally positioned conduit 48 that extends into the interior of vessel 40 a substantial distance. Conduit 48 is open ended to permit the discharge of the air stream from vessel 40 into the atmosphere.

Vessel 40 is preferably covered with insulation, not shown, that can be conventional fiberglass or asbestos insulation of suitable thickness, e.g., from one to about four inches. The vessel 40 serves as a mist detrainer to coalesce and condense entrained moisture from the air stream introduced into this vessel. This moisture is entrained in the air stream by the introduction of a limited amount of water into the casings of the centrifical blowers 32 to provide cooling in these blowers. The entrained liquid is coalesced by the centrifical action within vessel 40 and settles to the bottom of vessel for removal through conduit 46. The directional changes imparted to the air stream passing through vessel 40 and the insulation of the side walls of vessel 40 effect a substantial muffling of the noise of the air discharge from blower 32.

The invention as thus described and illustrated comprises an engineering prototype of the invention. Design modifications can be readily made to the aforedescribed embodiment to reduce its bulk and complexity and to provide a highly compact and versatile unit. A suitable modification of the aforedescribed prototype is illustrated in FIGS. 13 and 14 wherein the invention is applied for mounting on a conventional truck bed, e.g., a cab-over engine type truck having a frame 180 and tandem sets of rear wheels 182 and 184. In this embodiment, the vacuum support facilities are carried on a pair of longitudinal Z-frame members 185 and 186. Cylindrical vessel 188 is carried on the upper longitudinal flanges of the Z-frame members. This vessel 188 serves as a collection vessel for the wash water and solids which are picked up by the vacuum head. A cylindrical head 190 is carried on the upper portion of vessel 188 and bears a conventional dished head 192. The inlet vacuum line 194, which extends from the vacuum head of the unit, is attached to tangental nozzle 196 that is adapted for tangental introduction of the air stream into head 190. A suitable baffle plate can be provided internally of head 190 in a similar construction to baffle plate 130 of vessel 20 with its upper and lower plates 131 and 133, previously described. Similarly, the upper end of head 190 can support a conventional Zurn air separation unit 144 which communicates with the outlet nozzle 198 attached to the air line 200 which leads to the air blower 202 of the unit.

The air discharged by blower 202 is passed through line 204 to nozzle 206 which tangentally projects into a forward portion of cylindrical vessel 188. Vessel 188 is provided with an internal partition in the form of dished plate 208 that divides this vessel into an anterior, muffler compartment 210 and a main compartment 212 for collection of the wash water and entrained debris received from the vacuum head. The anterior chamber 210 is provided with a discharge nozzle 214 which projects a substantial distance into this compartment. Nozzle 214 is connected to stand pipe 216 which discharges the air stream to the atmosphere. A drain nozzle with associated drain valve 218 is provided communicating with a low point of compartment 210 in vessel 188 to permit draining of any coalesced liquid which collects within compartment 210.

Vessel 188 is entirely surrounded by a second vessel 221 having inclined bottom walls 220 and 222, side walls 224 and 226 and top wall 228. Internal stiffeners in the form of flat baffle plates 230 are provided between the walls of vessel 221 and the walls of cylindrical vessel 188. These baffle plates can bear, about their edges, stiffening hands 231 and 233. Baffle plates 230 are provided with a plurality of apertures 232 and 234 of suitable size and location to provide fluid communication between the baffles. Preferably, the baffles are truncated at the low point of the vessel 221 to provide fluid communication apertures 236. The baffles 230 thereby serve as reinforcement means for internal cylindrical vessel 188 and external vessel 221. The baffles also serve as splash plates to prevent oscillation and splashing of the liquid contained within vessel 221.

Vessel 221 serves to store the wash water for the spray nozzles of the vacuum head unit and for the spray header, not shown, within vessels 190 and 188. The water is supplied through conduit 238 dependent from a lower portion of vessel 221 to a water pump, not shown, carried on the Z-frame members 185 and 186 of the support facilities.

The entire support facilities can be mounted on the truck bed 180 by suitable hoist means whereby the Z-frame members 185 and 186 can be pivoted into an inclined position to permit drainage of liquid from vessel 188 through discharge nozzle 187. Such facilities include hydraulic cylinders 240 which are pivotally mounted at one end to the truck bed 180 and, at their opposite ends, to the support Z-frame members 185 and 186 whereby the latter can be elevated to a tilted position. The drain nozzle 187 is also provided with a hinged coverplate 189 to permit the opening of this nozzle and drainage of fluid contained within vessel 188.

The vacuum head employed with the support facilities described and illustrated in FIGS. 13 and 14 can be of similar construction to that shown in FIGS. 3–5 and can be employed on the front bumper of the truck in the manner illustrated for the mounting of vacuum head 10 on propulsion unit 60 in FIGS. 1 and 2. If desired, the vacuum unit could also be mounted beneath the frame 180 of the truck at a position intermediate the front and rear wheels of the truck.

The vessel 188 can also be provided with the spray header facilities such as 134 described in regard to vessel 20 and with suitable wash nozzles such as 174 positioned about the periphery of vessel 188.

It is essential to the proper operation of the cleaning unit that air vortexes such as shown in FIG. 6 be generated when the minimal volumetric flow of 200 standard cubic feet per minute per square inch of aperture area through the vortexes is achieved or exceeded and when the minimal or lower vacuum pressure in the head of 3 inches mercury below atmospheric pressure is achieved. Preferably, the air flow rate is from 200 to 500 standard cubic feet per minute per square inch aperture area at a pressure of at least 5 inches mercury below atmospheric pressure. Most preferably, the air flow rate is from 300 to 400 standard cubic feet per minute per square inch of aperture area at a pressure of at least about 6 inches mercury below atmospheric pressure. Lower pressure can be used, however, the performance of the cleaning unit is not markedly improved by use of pressures lower than about 7 inches mercury below atmospheric pressure and, accordingly, such low pressures are not required for efficient operation. The aforedescribed pressures are in the head of the unit.

The invention has been described by reference to the illustrated and presently preferred embodiments thereof. It is not intended that the invention be unduly limited by this disclosure. Instead, it is intended that the invention be defined by the means, steps, and their obvious equivalents, set forth in the following claims.

We claim:

1. A method for the removal of finely subdivided debris and foreign material from pavement and the like which comprises:

passing an open ended tubular member bearing inlet aperture means in its undersurface over the surface of said pavement;

developing a vacuum of at least about three inches mercury below atmospheric pressure in said member by removing air therefrom at a volumetric flow rate of at least about 200 standard cubic feet per minute per square inch of area of said aperture means to generate a well defined vortex in the air stream entering said member;

positioning the tubular member over said surface at a distance of from 0.5 to about 5 inches to locate the base of said vortex on the surface of said pavement and thereby entrain said debris and foreign material in said air stream.

2. The method of claim 1 including the steps of applying water spray onto said surface adjacent said vortex to wash said surface and entrain removed debris and wash water into said air stream.

3. The method of claim 1 wherein said air stream is passed to an air separator and is introduced tangentially therein while air freed of said debris and foreign material is axially withdrawn from said separator.

4. The method of claim 3 including the step introducing a water spray into said air stream before introduction of said air stream into said separator to facilitate separation of said debris and foreign material therefrom.

5. The method of claim 1 wherein said air is evacuated from said tubular member at a flow rate of from 200 to about 500 standard cubic feet per minute per square inch of flow area of said circular aperture.

6. The method of claim 1 wherein said vacuum is developed at a pressure of at least 5 inches mercury below atmospheric pressure.

7. The method of claim 1 wherein said vacuum is developed at a pressure of at least 6 inches mercury below atmospheric pressure.

8. A vacuum cleaning unit which comprises:

a tubular cleaning head;

a plurality of circular air intake apertures positioned along the undersurface of said tubular head;

means connecting said spray nozzles to a pressured supply of water; and vacuum means connecting said header to air pump means having a capacity of at least about 200 standard cubic feet per minute per square inch of total flow area of said apertures at a subatmospheric pressure of at least 3 inches mercury below atmospheric pressure.

9. The cleaning unit of claim 8 wherein said circular air intake apertures are disposed in a longitudinal row along the undersurface of said tubular head.

10. The cleaning unit of claim 8 wherein said tubular head bears a longitudinal plate extending along its forward edge and inclined to the horizontal to form a mounting plate and wherein a plurality of water spray nozzles are carried in a longitudinal row on said plate and oriented to direct their discharges beneath said air intake apertures.

11. The cleaning unit of claim 10 wherein said head bears two of said mounting plates, one each disposed along the forward and trailing edge of said cleaning head and each of said plate bears a longitudinal row of said water spray nozzles.

12. The cleaning unit of claim 8 wherein said tubular head includes a head housing defined by a upper, central plate and inclined side plates extending fore and aft thereof, each of said inclined plates bearing a return bend at its lower edge, a generally trough-shaped bottom plate having a flat central portion bearing said aperture means in a longitudinal row thereon and upwardly inclined side plates extending into engagement with the undersurface of said inclined fore and aft plates to thereby define a six-sided tubular compartment.

13. The cleaning unit of claim 12 wherein a plurality of water spray nozzles are disposed in longitudinal rows along the lower portion of said inclined fore and aft side plates and are directed to discharge their sprays beneath said circular air intake apertures.

14. The cleaning unit of claim 8 wherein said vacuum means includes an air entrainment separator comprising a circular vessel with air stream inlet means thereto to direct the air stream in a tangental direction as it enters said vessel.

15. The cleaning unit of claim 14 wherein said air entrainment separator includes an arcuate baffle means carried on the inside wall of said vessel adjacent the air inlet thereto to deflect said air stream in a tangental direction about the inside wall of said vessel.

16. The cleaning unit of claim 15 wherein said air separator vessel includes a centrifugal separator centrally positioned therein to receive air from said vessel and to discharge clarified air therefrom.

17. The cleaning unit of claim 16 wherein said centrifugal separator has an ejector leg for discharge of separated solids therefrom including check valve means carried on said leg to prevent the inflow of air through said ejector leg.

18. The cleaning unit of claim 17 wherein said check valve means comprises an elbow carried on the end of said ejector leg with a flapper valve pivotally mounted thereon.

19. The cleaning unit of claim 8 including support facilities comprising an air entrainment separator in the form of a vessel surrounding said circular vessel with a plurality of transverse baffle plates therebetween to serve as vessel reinforcement means and splash plates.

20. The cleaning unit of claim 19 wherein said support facilities are carried on frame members pivotally mounted on a truck frame with bydraulic means to tilt said frame members and associated support facilities into an elevated position to permit water to be drained from said circular vessel.

* * * * *